US007584705B2

(12) United States Patent
Chen

(10) Patent No.: US 7,584,705 B2
(45) Date of Patent: Sep. 8, 2009

(54) MONITOR RISING AND STORING SYSTEM

(76) Inventor: Chao-Lin Chen, P.O. Box 44-2049, Taipei (TW) 10668

( * ) Notice: Subject to any disclaimer, the term of this patent is extended or adjusted under 35 U.S.C. 154(b) by 465 days.

(21) Appl. No.: 11/518,269

(22) Filed: Sep. 11, 2006

(65) Prior Publication Data

US 2008/0060560 A1 Mar. 13, 2008

(51) Int. Cl.
*A47B 51/00* (2006.01)

(52) U.S. Cl. ..... 108/50.01; 108/50.02; 108/25; 108/26; 312/7.2; 312/312; 312/223.3

(58) Field of Classification Search ..... 312/7.2, 312/312, 319.5, 319.6, 319.7, 319.8, 223.2, 312/306, 196, 21, 22, 23, 242, 247, 325; 108/50.01, 50.02, 25, 26; 361/681, 682; 74/25; 248/918, 919, 920, 921, 922, 166, 248/276.1, 284.1

See application file for complete search history.

(56) References Cited

U.S. PATENT DOCUMENTS 3,761,152 A * 9/1973 Cory ..... 312/7.2
4,065,194 A * 12/1977 Mattia ..... 312/247
6,039,200 A * 3/2000 Armor ..... 220/263
6,256,078 B1 * 7/2001 Ogata ..... 349/58
6,540,311 B2 * 4/2003 Canedy et al. ..... 312/114
6,612,670 B2 * 9/2003 Liu ..... 312/312
6,733,094 B1 * 5/2004 Chang ..... 312/7.2
6,902,243 B2 * 6/2005 Bober ..... 312/306
6,981,606 B2 * 1/2006 Yang et al. ..... 220/23.87
7,207,278 B2 * 4/2007 Latino et al. ..... 108/50.01
7,225,943 B2 * 6/2007 Yang et al. ..... 220/263

* cited by examiner

*Primary Examiner*—Khoa D Huynh
*Assistant Examiner*—Salvatore D Zagarella

(57) ABSTRACT

A system for rising and storing a monitor to a desk includes a box located beneath a top of the desk and having a top hole. A link mechanism includes a transverse bar on which the base of the monitor is rested and two first links are pivotably connected to two ends of the transverse bar. The two first links are pivotably connected to two first ends of two plates which are pivotably connected to the box by two respective mediate portions. Two second links are connected to two second ends of the plates and a cover for closing a top hole of the box. Two springs are connected between the plates and two protrusions on the first links. The cover is moved vertically into the top hole of the box and then pivoted an angle when the monitor is moved through the top hole.

2 Claims, 5 Drawing Sheets

MONITOR RISING AND STORING SYSTEM

BACKGROUND OF THE INVENTION (1) Field of the Invention

The present invention relates to a system for rising and storing a monitor, wherein only a small opening is required in the top of the desk when moving the monitor.

(2) Description of the Prior Art

A conventional system 100 for raising and storing a monitor 300 to a desk is shown in FIG. 1 and generally includes a box 101, a motor 102, a driving mechanism 103 and a cover 104. The box 101 is located under a top 200 of the desk and includes a receiving space 101*a* and an opening 101*b* on a top of the box 101. The motor 102 is located in the receiving space 101*a* so as to activate a support device 103 in the box 101. The support device 103 has a support board 103*a* such the monitor 300 is fixed on the support board 103*a*. The cover 104 can close the opening 101*b* and is opened along with the upward movement of the monitor 300.

In order to let the lower edge of the monitor 300 be in flush with the top surface of the top of the top 200 of the desk, a significant size of opening has to be cut in the top 200 of the desk. Although the opening in the top 200 can be covered by the cover 104, the desk looks award when the cover 104 closes the opening of the top 200.

The present invention intends to provide a system for rising and storing a monitor wherein the cover for closing the opening of the desk can be vertically moved into the opening then pivoted such that the size of the opening of the desk can be made as small as possible.

SUMMARY OF THE INVENTION

The present invention relates to a system for rising and storing a monitor through an opening in the desk includes a box located beneath a top of the desk and the box has a space defined therein and a top hole is defined in a top of the box. The top hole communicates with the space. A motor is located in the space and a guide rail is located on an inside of the box. A base connected with a monitor is located in the space the monitor is driven along the guide rail.

A link mechanism is located in the box and includes a transverse bar, two first links, two plates and two second links. Two first frames are located on two opposite insides of the box and each first frame has a first slot. Two ends of the transverse bar are movably engaged with the two first slots of the two first frames. The base is rested on the transverse bar. Each first link has a first end pivotably connected to one of the two ends of the transverse bar and a protrusion extends laterally from each of the first links. The two plates are pivotably connected to two supports on the two opposite insides of the box at two respective mediate portions of the two plates. A second end of each first link is pivotably connected to a first end of the plate corresponding thereto. Two second frames are connected to the two opposite insides of the box and each second frame has a second slot defined therein. The two second frames are located higher than the first frames in vertical direction.

The two second links each have a first end pivotably connected to a second end of the plate corresponding thereto and a second end of each second link is movably engaged with the second slot of the second frame corresponding thereto. A cover removably closes the opening of the desk and has two side portions extending vertically from two ends of the cover. The two side portions are pivotably connected to the two respective second ends of the second links. Two springs are connected between the protrusions of he two first links and the two supports of the two plates so as to exert an upward force to the transverse bar. When the monitor rises, the plates pull the second link downward to move the cover directly into the space of the box.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
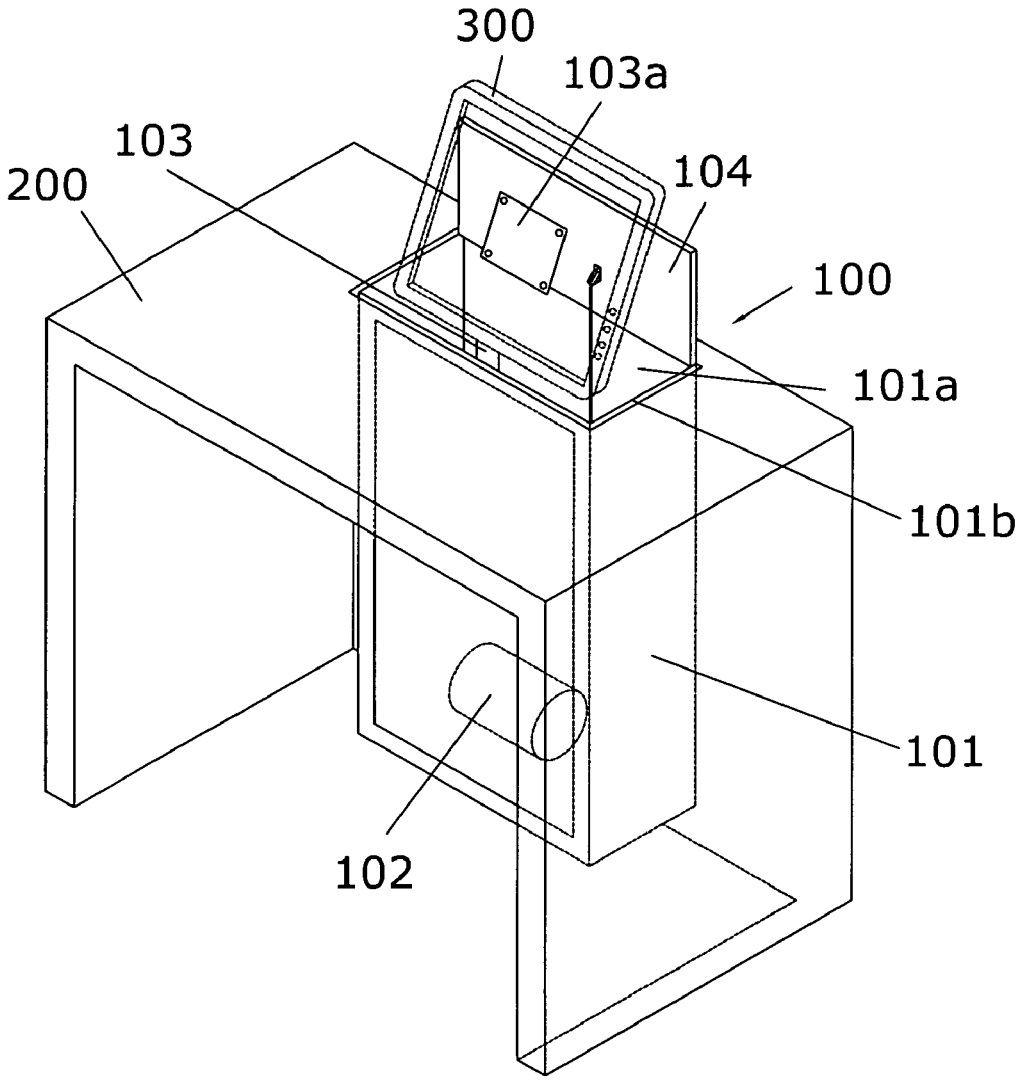
FIG.1 Prior Art
FIG. 1 shows a conventional system for rising and storing a monitor to a desk.
Figure 2:
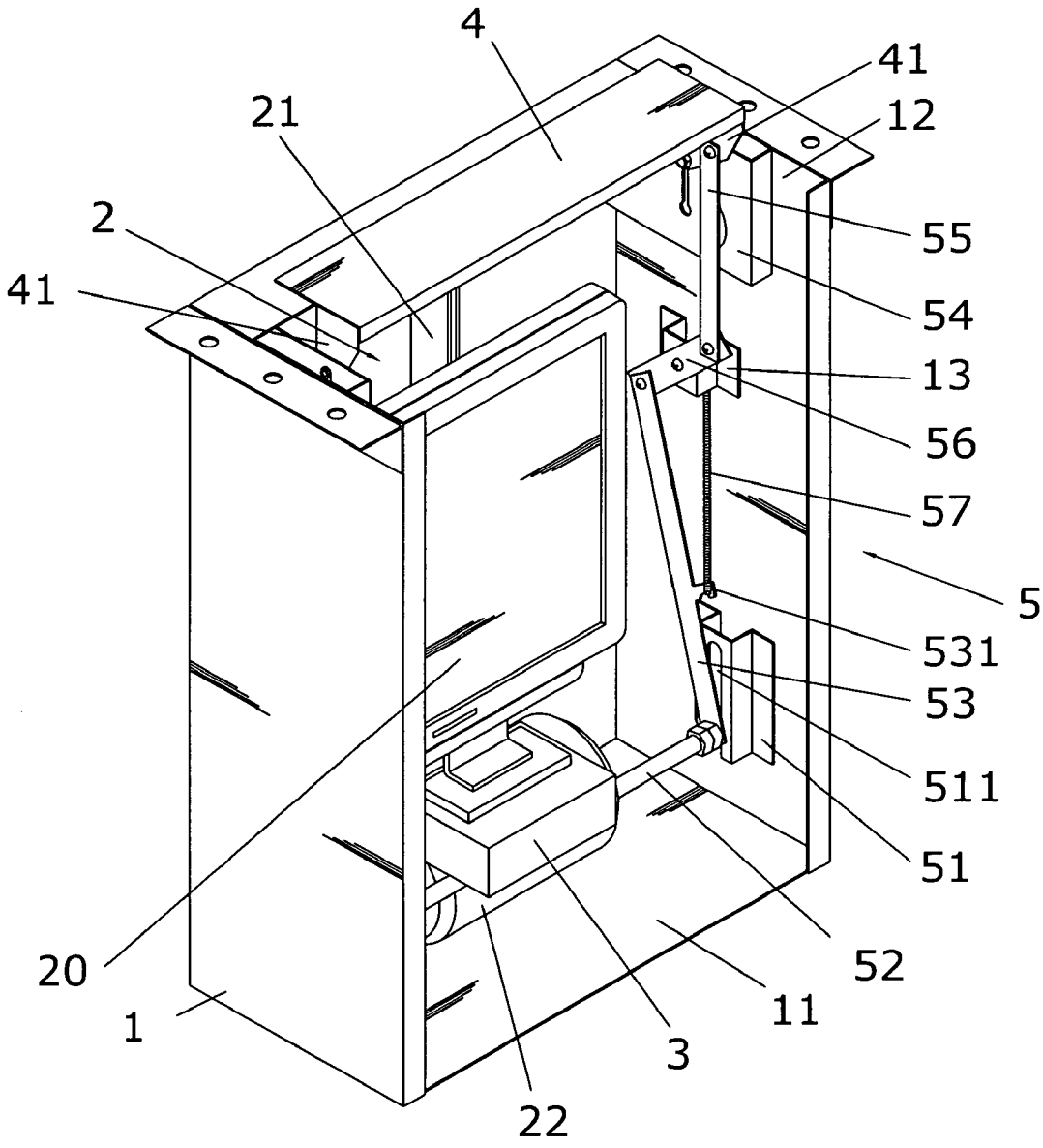
FIG. 2 shows the system for rising and storing a monitor of the present invention.
Figure 3:
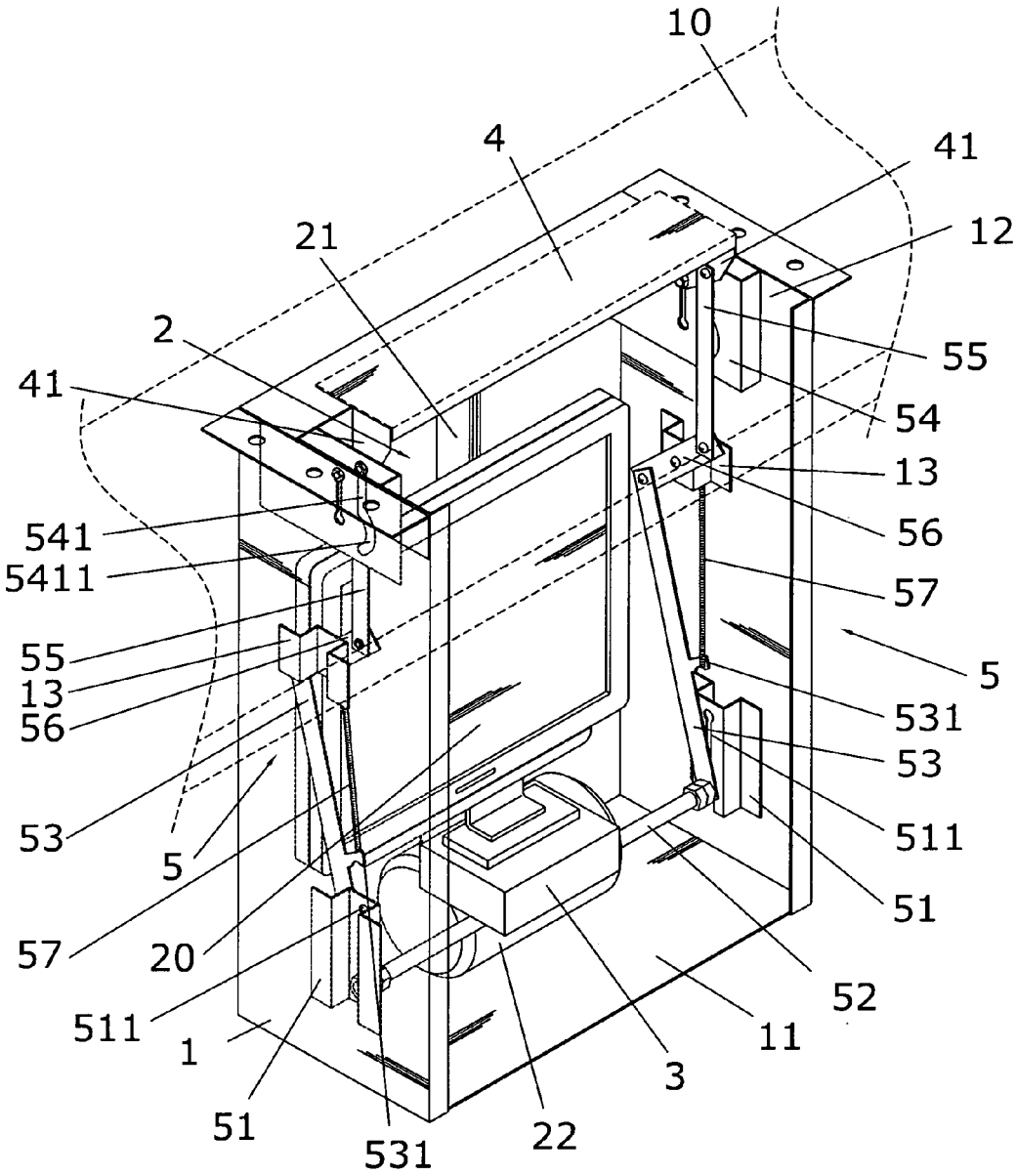
FIG. 3 is a perspective view to show the system for rising and storing a monitor of the present invention.

Referring to FIGS. 2 and 3, the system for rising and storing a monitor 20 comprises a box 1 having a space 11 defined therein and a top hole 12 is defined in a top of the box 1. The top hole 12 communicates with the space 11. The box 1 is located beneath a top 10 of a desk and an opening 101 is defined through the top 10. The top hole 12 communicates with the space 11.

A motor 22 is located in the space 11 and a guide rail 21 is located on an inside of the box 1. A base 3 connected with a monitor 20 is located in the space 11 and the monitor 20 drives by the motor 22 along the guide rail 21 so that the monitor 22 can be moved upward through the top hole 12 of the box and the opening 101 of the top 10 of the desk, or be lowered and stored in the box 1.

A link mechanism 5 received in the box 1 and includes a transverse bar 52, two first frames 51 on two opposite insides of the box 1, two first links 53, two plates 56, two second links 55 and two second frames 54. Each first frame 51 has a first slot 511 defined therein and two ends of the transverse bar 52 are movably engaged with the two first slots 511 of the two first frames 51. The base 3 is rested on the transverse bar 52 when the monitor 20 is stored in the box 1. The two first link 53 are on the two opposite insides of the box 1 and each first link 53 has a first end pivotably connected to one of the two ends of the transverse bar 52. A protrusion 531 extends laterally from the first link 53.

The two plates 56 are pivotably connected to two supports 13 on the two opposite insides of the box 1 at two respective mediate portions of the two plates 56, so that the first end and the second end of each plate 56 can be moved up and down about the mediate portion. A second end of each first link 53 is pivotably connected to the first end of the plate 56 corresponding thereto. The two second frames 54 are connected to the two opposite insides of the box 1 and each second frame 54 has a second slot 541 defined therein. Each second slot 541 includes a curved trace 5411. The two second frames 54 are located higher than the first frames 51 in vertical direction relative to a horizontal direction.

The two second links 55 each have a first end pivotably connected to the second end of the plate corresponding thereto and a second end of each second link 55 is movably engaged with the second slot 541 of the second frame 54 corresponding thereto.

A cover 4 removably closes the opening 101 of the top 10 of the desk and has two side portions 41 extending vertically from two ends of the cover 4. The two side portions 41 are pivotably connected to the two respective second ends of the second links 55. Two springs 57 are connected between the protrusions 531 of the two first links 53 and the two supports 13 of the two plates 56 so as to exert an upward force to the transverse bar 52.

Figure 4:
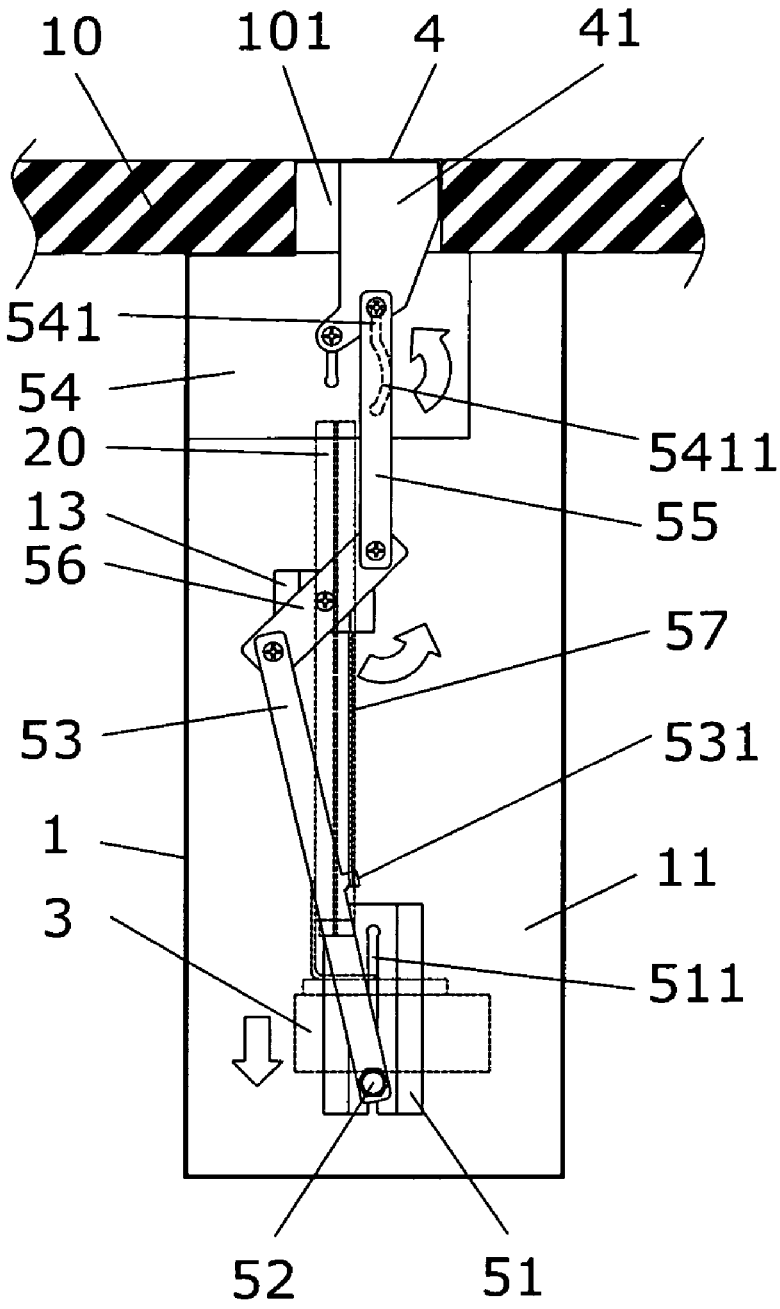
FIG. 4 is a side view to show that the monitor is lowered and the cover closes the top hole of the box.

As shown in FIG. 4, when the monitor 20 is stored in the box 1, the base 3 is rested on the transverse bar 52 and the first links 53 are located at the lower ends of the first slots 511 in the first frames 51. The first end of each plate 56 is at the low position while the second end of each plate 56 is located at high position, and the second links 55 push the two side portions 41 of the cover 4 to close the top hole 12 of the box 1.

Figure 5:
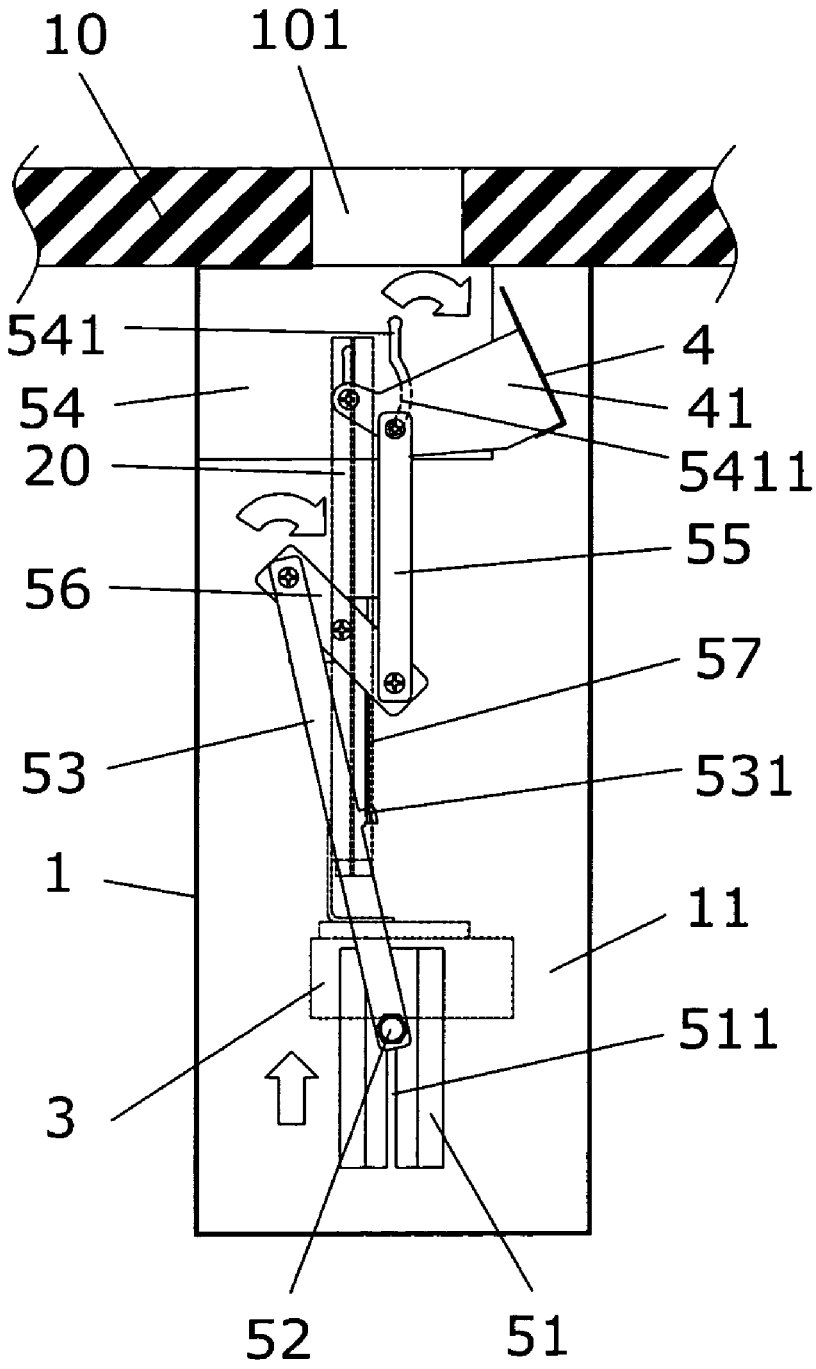
FIG. 5 is a side view to show that the monitor is risen and the cover moved downward.

As shown in FIG. 5, when the monitor 20 is driven by the motor 22 to move upward, the base 3 is removed from the transverse bar 52 and the springs 57 pull the first links 53 and the transverse bar 52 upward along the first slots 511. The plates 56 are then pivoted about the two respective mediate portions, so that the second links 55 are moved downward along the second slots 541. The second links 55 pull the side portions 41 of the cover 4 downward vertically. After the cover 4 is received in the box 1, the second links 55 together with the side portions 41 move along the curved trace 5411 and the cover 4 is pivoted an angle. Therefore the top hole 12 is needed to be made the same size as the cover 4.

While we have shown and described the embodiment in accordance with the present invention, it should be clear to those skilled in the art that further embodiments may be made without departing from the scope of the present invention.

What is claimed is:

1. A rising and storing system used in combination with a monitor, comprising:

a box having a space defined therein and a top hole defined in a top of the box, the top hole communicating with the space;

a motor located in the space and a guide rail located on an inside of the box, a base connected with the monitor located in the space, the monitor driving by the motor and movably connected with the guide rail;

a link mechanism including two first frames on two opposite insides of the box and each first frame having a first slot defined therein, a transverse bar having two ends movably engaged with the two first slots of the two first frames, the base rested on the transverse bar, two first link on the two opposite insides of the box and each first link having a first end pivotably connected to one of the two ends of the transverse bar, a protrusion extending laterally from the first link;

two plates pivotably connected to two supports on the two opposite insides of the box at two respective mediate portions of the two plates, a second end of each first link pivotably connected to a first end of the plate corresponding thereto;

two second frames connected to the two opposite insides of the box and each second frame having a second slot defined therein, the two second frames being located higher than the first frames in vertical direction;

two second links each having a first end pivotably connected to a second end of the plate corresponding thereto and a second end of each second link movably engaged with the second slot of the second frame corresponding thereto;

a cover adapted to be removably close an opening of a desk and having two side portions extending vertically from two ends of the cover, the two side portions pivotably connected to the two respective second ends of the second links, and two springs connected between the protrusions of he two first links and the two supports of the two plates so as to exert an upward force to the transverse bar.

2. The system as claimed in claim 1, wherein each second slot includes a curved trace.

* * * * *